US009038927B2

(12) United States Patent
Denzler

(10) Patent No.: US 9,038,927 B2
(45) Date of Patent: May 26, 2015

(54) PLUMBING SPOUT DEVICE

(75) Inventor: Oliver Denzler, Bottmingen (CH)

(73) Assignee: NEOPERL GMBH, Mullheim (DE)

( * ) Notice: Subject to any disclaimer, the term of this patent is extended or adjusted under 35 U.S.C. 154(b) by 925 days.

(21) Appl. No.: 12/891,431

(22) Filed: Sep. 27, 2010

(65) Prior Publication Data

US 2011/0073204 A1 Mar. 31, 2011

Related U.S. Application Data

(63) Continuation of application No. 10/590,007, filed as application No. PCT/EP2005/001702 on Feb. 18, 2005, now abandoned.

(30) Foreign Application Priority Data

Feb. 21, 2004 (DE) ..... 10 2004 008 594

(51) Int. Cl.
*E03C 1/08* (2006.01)
*E03C 1/086* (2006.01)

(52) U.S. Cl.
CPC .. *E03C 1/086* (2013.01); *E03C 1/08* (2013.01)

(58) Field of Classification Search
CPC ..... E03C 1/08; E03C 1/086; B05B 15/065
USPC ..... 239/428.5, 553.3, 553.5, 575, 580, 590, 239/590.3, 590.5, 600
See application file for complete search history.

(56) References Cited

U.S. PATENT DOCUMENTS

| | | | | |
|---|---|---|---|---|
| 3,014,667 | A | 12/1961 | McLean et al. | |
| 3,363,841 | A * | 1/1968 | Aghnides | 239/428.5 |
| 3,630,455 | A | 12/1971 | Parkison | |
| 3,851,825 | A | 12/1974 | Parkison et al. | |
| 4,534,513 | A * | 8/1985 | Aghnides | 239/428.5 |
| 4,534,514 | A * | 8/1985 | Aghnides | 239/428.5 |
| 4,722,509 | A | 2/1988 | Delker et al. | |
| 5,467,929 | A * | 11/1995 | Bosio | 239/428.5 |
| 5,769,326 | A | 6/1998 | Muchenberger et al. | |
| 6,126,093 | A | 10/2000 | Grether et al. | |
| 6,152,182 | A | 11/2000 | Grether et al. | |
| 6,513,731 | B2 | 2/2003 | Griffin et al. | |
| 6,892,964 | B2 | 5/2005 | Grether et al. | |
| 6,902,123 | B2 | 6/2005 | Grether et al. | |

FOREIGN PATENT DOCUMENTS

| | | |
|---|---|---|
| CH | 380042 A | 7/1964 |
| DE | 2012355 | 10/1971 |

(Continued)

*Primary Examiner* — Ryan Reis
(74) *Attorney, Agent, or Firm* — Volpe and Koenig, P.C.

(57) ABSTRACT

A plumbing spout device which has a jet regulating device is provided, which is situated on an outflow side from an upstream attachment screen in a direction of flow. The jet regulating device is provided in the form of a perforated plate having at least a perforated field in at least a partial area thereof. The spout device has a mounting sleeve that supports the jet regulating device on an outflow side sleeve end area thereof, and the mounting sleeve is joined to the water spout of the plumbing spout fitment via a screwed, clip, detent, adhesive or welded connection. The spout device has a comparatively low installation height that does not significantly limit design possibilities when designing associated spout fitments. The spout device also makes it possible to achieve a high jet quality and a good jet pattern.

13 Claims, 5 Drawing Sheets

(56) References Cited

FOREIGN PATENT DOCUMENTS

| | | | |
|---|---|---|---|
| DE | 3000799 | | 7/1981 |
| DE | 3440883 | | 5/1986 |
| DE | 4333549 | A1 | 4/1995 |
| DE | 20010099 | U1 | 9/2000 |
| DE | 10149335 | A1 | 4/2003 |
| DE | 10162662 | A1 | 7/2003 |
| EP | 0631020 | A | 12/1994 |
| GB | 336200 | A | 10/1930 |
| WO | 9418402 | | 8/1994 |

* cited by examiner

PLUMBING SPOUT DEVICE

CROSS REFERENCE TO RELATED APPLICATIONS

This application is a continuation of U.S. patent application Ser. No. 10/590,007, filed Aug. 21, 2006, which is a 371 of International Application No. PCT/EP2005/001702, filed Feb. 18, 2005, which claims priority to German Application No. 10 2004 008 594.3, filed Feb. 21, 2004, the entire contents of all of which are incorporated by reference as if fully set forth.

BACKGROUND

The invention relates to a plumbing spout device with a mounting sleeve, which is connected to the water spout of a plumbing spout fitment via a screw, clip, detent, adhesive, or weld connection, as well as with a jet-regulating device, with an attachment screen being connected upstream of this jet-regulating device in the direction of flow and with the jet-regulating device being embodied as a perforated plate, which has a perforated area at least in a partial region.

In order to shape the water flow through a plumbing spout fitment into a homogeneously soaking, non-spraying water jet, various known spout devices have already become known.

Devices that are already known here include a jet disrupter, which can be inserted into the spout nozzle of a spout fitment and which has several radial walls, which are arranged in the shape of a star relative to each other and with their flat sides parallel to the direction of flow. However, these previously known jet disrupters cannot satisfy high demands for the jet flow quality.

Therefore, jet regulators have also been created, which have a jet splitting device formed as a perforated plate. In this jet splitting device, the incoming water flow is split into many individual jets. The individual jets, that can still be aerated if necessary, are then combined in a jet-regulating device connected downstream in the direction of flow back into the desired homogeneous, bubbling, and non-spraying complete jet. Here, the jet-regulating device can also be formed as a perforated plate having a honeycomb-like perforated field at least in a partial area.

In order not to negatively affect these functional units which are connected one after the other, the jet splitting device and also the subsequent jet-regulating device, due to contaminant particles entrained in the water flow, the jet splitting device can have an attachment screen connected upstream.

Thus, from DE 101 49 335 A1, a jet regulator with a sleeve-shaped housing is already known, in which several jet-regulating devices are provided. Here, several additional jet-regulating devices, which have a wire-mesh form and whose mesh is formed from fine, crossing members, are arranged on the outflow side of a jet-regulating device formed as a perforated plate. An attachment screen, which covers the supply-side front end of the sleeve-shaped housing, is connected upstream of these jet-regulating devices. Such an attachment screen, which can be connected upstream of a jet regulator in the direction of flow, is already known from DE 43 33 549 A1.

These previously known jet regulators distinguish themselves through a high jet quality and a good jet pattern of the complete jet that is produced. However, these previously known jet regulators have a large installation height, which considerably limits the possibilities for shaping the associated plumbing spout fitment, due to the various functional units connected one after the other.

From U.S. Pat. No. 3,630,455 a plumbing spout fitment with a two-part mounting sleeve is known, which can be screwed into a corresponding internal thread on the water spout of a plumbing spout fitment with an external thread on the outflow-side sleeve part. In the interior space enclosed by the two sleeve parts of the mounting sleeve, a pot-shaped jet-regulating device is provided, whose pot bottom is embodied as a perforated plate with a perforated area. An attachment screen is connected upstream of this jet-regulating device in the direction of flow. In order to be able to house the pot-shaped jet-regulating device in the inner space enclosed by the two sleeve parts, the jet-regulating device is arranged approximately in the middle of the mounting sleeve. However, the multiple-part arrangement of the previously known spout device, the two-part construction of the mounting sleeve, and also the pot-shaped jet-regulating device housed therein require a relatively large installation length of the previously known spout device.

From CH-A-380 042, a spout fitment is known, in whose water spout a jet regulator can be inserted. This jet regulator has a mounting sleeve, which has an outflow-side jet-regulating device formed from several metal screens arranged one on top of the other. Since these metal screens have a relatively small longitudinal extent, these must be held at a slight distance from each other and the screen edge must be flanged as a spacer. Another metal screen is connected on the supply side as an attachment screen upstream of the jet-regulating device formed from several metal screens. This previously known spout device also has many parts and is relatively long.

From DE 200 10 099 U1, a similarly designed jet regulator is known, which can be inserted into a spout nozzle that can be mounted on an internal thread on the water spout of a plumbing spout fitment. However, the spout nozzle required for mounting the previously known jet regulator negatively affects the aesthetic appearance of the plumbing spout fitment and significantly restricts the possibilities for its design.

SUMMARY

Therefore, there is the objective of creating a plumbing spout device of the type named above, which distinguishes itself through a high jet quality and a good jet pattern and which nevertheless leaves room open for possibilities in shaping the spout fitment.

This objective is achieved according to the invention in that, for the spout device of the type named above, the outflow-side jet-regulating device is arranged on the spout-side sleeve end region of the mounting sleeve and the jet-regulating device is formed in one piece on the mounting sleeve.

The spout device according to the invention has a mounting sleeve, which carries the attachment screen and a jet-regulating device. While the jet-regulating device is connected in one piece to the mounting sleeve on the spout-side sleeve end region of the mounting sleeve, the attachment screen is connected upstream in the region of the supply-side sleeve end region of the jet-regulating device in the direction of flow. Therefore, the spout device according to the invention can be embodied with a relatively small installation height, without negatively affecting the jet quality significantly.

To influence the jet quality even more favorably, it can be advantageous when a screen-like or grating-like insert part or a similar functional element is connected between the attachment screen and the jet-regulating device.

However, a preferred embodiment according to the invention provides that an attachment screen is connected directly upstream of the jet-regulating device without other insert parts or functional units being connected in-between. Surprisingly, it has been shown that the jet-regulating device connected downstream of the attachment screen in the direction of flow and having a perforated area in at least a partial region is already adequate for producing a homogeneously soaking and non-spraying water jet. In the spout device according to the invention, since many different functional units can be eliminated and since the spout device according to the invention is composed essentially of only the preferably plate-shaped jet-regulating device and the attachment screen connected upstream, the spout device according to the invention has a relatively small installation height. Due to its small installation height, the spout device according to the invention leaves room open for possibilities in the design of the associated spout fitment.

An especially simple and preferred embodiment according to the invention provides that the mounting sleeve carries an external thread, which can be screwed into an internal thread on the water spout of the plumbing spout fitment.

The spout device according to the invention can present its special advantages primarily when the volume flow through the spout fitment is not too large. In order to keep the water flow through the spout device according to the invention to a preferred volume, it is advantageous when a flow rate regulator or a flow rate limiter is connected upstream of the attachment screen in the direction of flow.

The small installation height of the spout device according to the invention is preferred when the attachment screen, at least with its outer edge region, directly contacts the supply side of the jet-regulating device. Here, a preferred embodiment according to the invention provides that the attachment screen has a conical shape. For a conically shaped attachment screen, contaminant particles possibly entrained in the water flow can be deposited on the outer edge region of the attachment screen, without significantly restricting the screening area of the attachment screen.

The high jet quality and the perfect jet pattern of the spout device according to the invention is promoted when a neck in the housing is connected after the jet-regulating device for forming a jet on the outlet end of the spout device.

It is possible that the jet-regulating device is connected to the mounting sleeve via a weld, adhesive, clip, or screw connection. However, a preferred embodiment according to the invention provides that the jet-regulating device is formed in one piece on the mounting sleeve.

Here, it is especially advantageous when the jet-regulating device formed on the mounting sleeve and/or the attachment screen is formed as a plastic part.

To be able to insert the relatively flat spout device into the associated spout fitment, it is advantageous when the spout device has a contoured outer outline and/or a contoured outflow end side, which is embodied as a tool attachment surface for a tool insert. Here, the contoured outer outline or the contoured outflow end side of the spout device according to the invention can also be arranged on its mounting sleeve.

An especially advantageous embodiment according to the invention provides that the outflow end side of a spout device has contouring formed from end projections and recesses, such that the recesses of a spout device held in a spout fitment act as a tool attachment surface for the projections of another spout device that can be used as a tool insert. Thus, the spout device held in the spout fitment can be unscrewed with another spout device, which is complementary at least externally or has the same structure and which is used here as a tool insert and is designed for replacement. The spout device initially used as a tool insert can then be screwed into the water spout of the spout fitment with the help of the spout device which was previously removed from the spout fitment. In this particularly advantageous embodiment according to the invention, no additional tool inserts are necessary.

A preferred embodiment according to the invention provides that the perforated area of the jet-regulating device embodied as a perforated plate has a honeycomb-like shape. A jet-regulating device embodied as a honeycomb-like perforated plate offers a large throughput cross section, with the honeycomb-like guide walls that define the holes of the jet-regulating device leading the individual jets formed in the holes of the perforated plate together especially well into a homogeneously soaking complete jet on the outlet side.

However, the perforated area of the jet-regulating device embodied as a perforated plate can also have, for example, approximately rectangular throughput holes. However, another advantageous embodiment according to the invention provides that the perforated area of the jet-regulating device is divided by approximately radial longitudinal walls and approximately concentric peripheral walls into approximately circular segment-like throughput holes.

It is especially advantageous when the spout device is embodied as a jet regulator, jet disrupter, or flow straightener.

Additional features of the invention emerge from the following description of the embodiments according to the invention in connection with the claims as well as the drawing. The individual features can be realized individually or in combination for an embodiment according to the invention.

BRIEF DESCRIPTION OF THE DRAWINGS

Shown are.

DETAILED DESCRIPTION OF THE PREFERRED EMBODIMENTS

Figure 1:
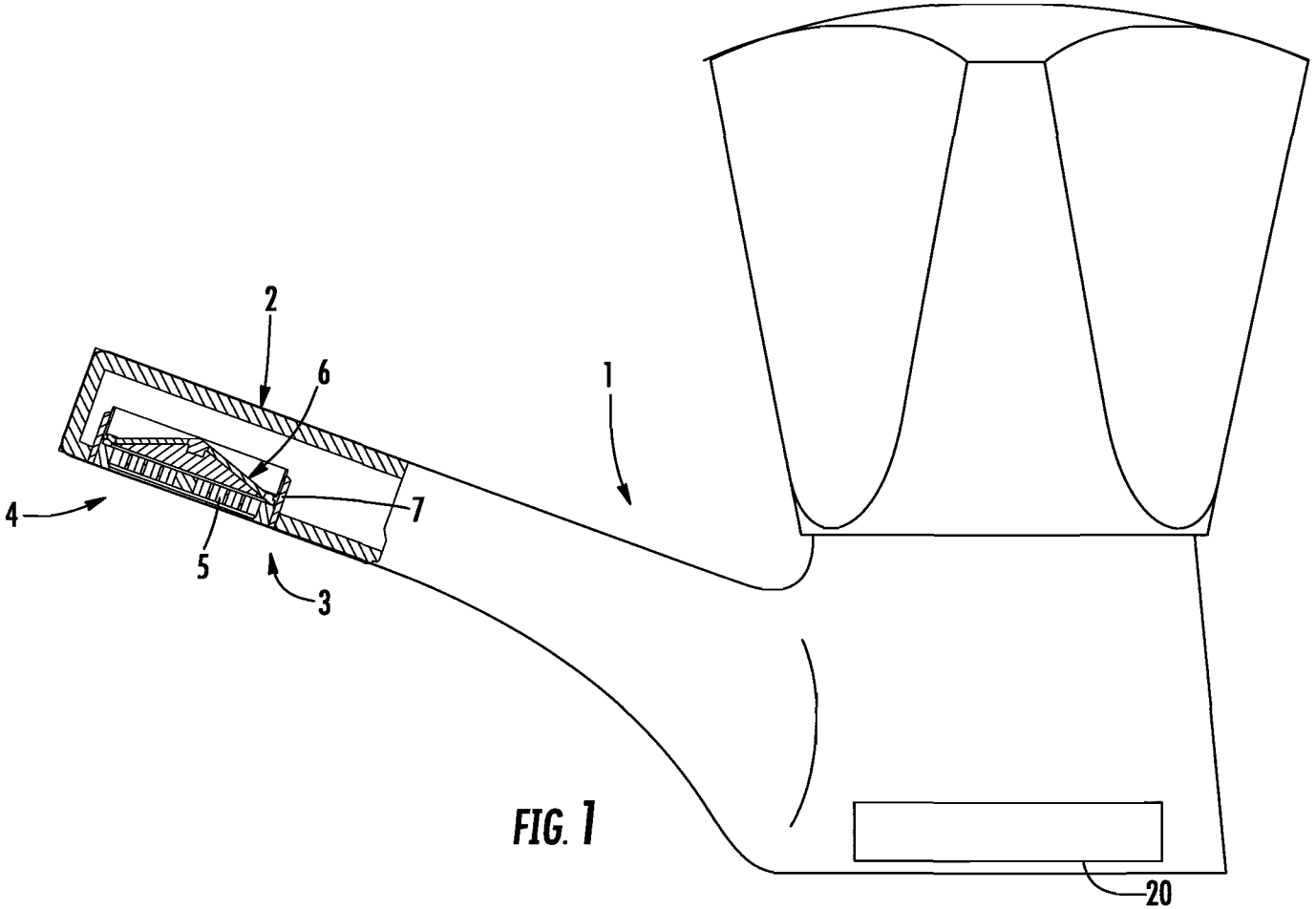
FIG. 1 a plumbing spout fitment, which is shown in cross-section in a region of its water spout, with a plumbing spout device being arranged in the water spout of this spout fitment, FIG. 2 the spout fitment from FIG. 1 in a perspective view in the region of its water spout, FIG. 3 the spout fitment from FIGS. 1 and 2 in a cross section in the area of its water spout, FIG. 4 the spout device from FIGS. 1 to 3 in a cross-sectional view, FIG. 5 the spout device from FIG. 4 in a top view on its outlet side, FIG. 6 a spout fitment, similar to FIG. 1 and whose water spout is here limited by a mounting bushing, in which mounting bushing the spout device can be inserted, FIG. 7 a spout device, which is comparable to FIGS. 1 to 5, which is shown here in a top view, and whose contoured outflow end side is used as a tool attachment surface for a tool insert, FIG. 8 the spout device from FIG. 7 in a longitudinal section, and FIG. 9 the spout device from FIGS. 7 and 8 in a perspective top view on its contoured outflow end side.
Figure 2:
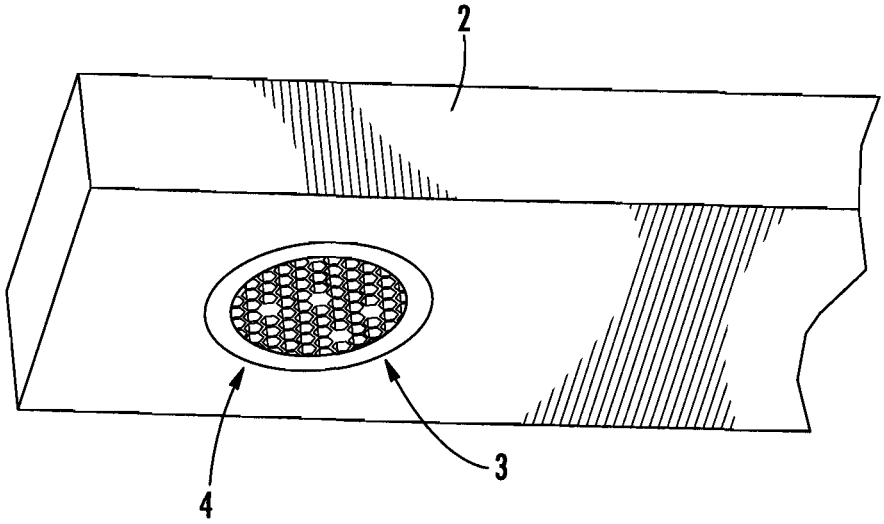
Figure 3:
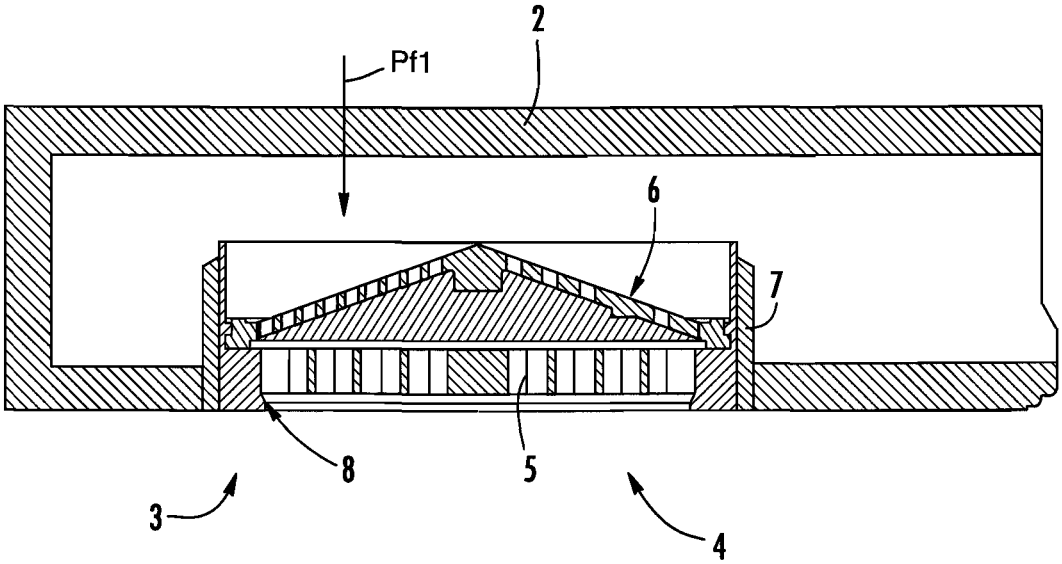

In FIGS. 1 to 3, a plumbing water spout fitment 1 is shown in various views. As is clear from FIG. 2, the spout fitment 1 has a relatively flat, rod-like spout end piece 2. The water spout 3 of the spout fitment is provided on the bottom flat side of the spout end piece 2.

In the water spout 3, a sanitary spout device 4 is arranged, which is designed for forming a homogeneously soaking and non-spraying water jet. The spout device 4 has a jet-regulating device 5, which is situated on the outflow side and connected to an upstream attachment screen 6 in the direction of flow Pf1. The spout device 4 is shown in more detail in FIGS. 4 and 5.

Figure 5:
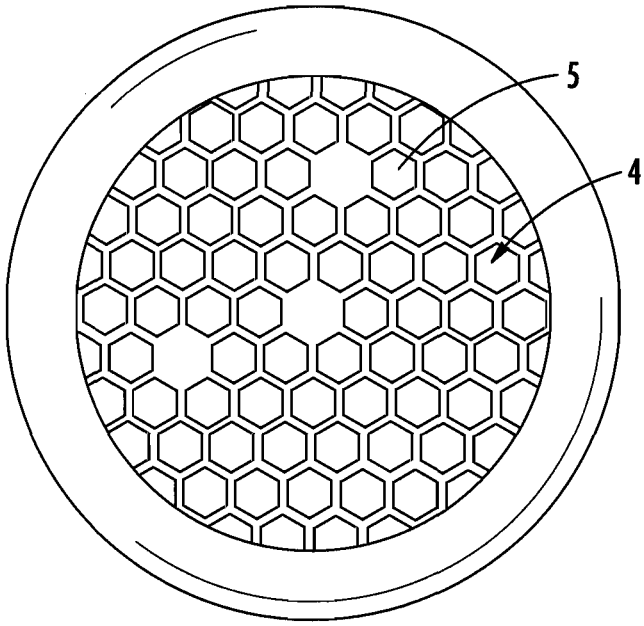
Figure 4:
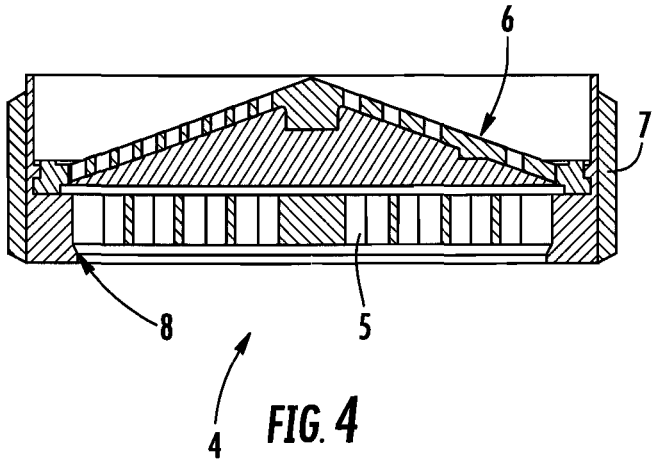

As is clear from FIGS. 3 to 5, the jet-regulating device 5 is formed as a perforated plate, which has a honeycomb-like perforated area over practically its entire end surface. The jet-regulating device 5 is formed in one piece on a mounting sleeve 7, which carries the jet-regulating device 5 on its spout-side sleeve end region. On the outer periphery of the mounting sleeve 7 there is an external thread, which interacts with the internal thread on the water spout 3.

From FIG. 3 it is clear that the internal thread can be machined into the spout end piece 4 of the spout fitment 1 without great expense. Because the internal thread necessary for fixing the spout device 4 is to be cut only into the water spout 3, the production of the spout fitment 1 formed, for example, as a cast part, is simplified significantly.

From FIGS. 3 and 4, it is clear that the attachment screen 6 is connected directly upstream of the jet-regulating device 5 without intermediate connection of other installation parts or functional units. Because the spout device shown here is composed from essentially the jet-regulating device 5 and the upstream-connected attachment screen 6, the spout device 4 can be equipped with a relatively small installation height. This small installation height leaves room open for design freedom in the shaping of the spout fitment 1. Despite its small installation height, the spout device 4 distinguishes itself through a high jet quality and a good jet pattern. To limit the quantity of water flowing through the spout device, it can be advantageous when a throughput limiter or a flow rate regulator 20 (FIG. 1) is connected upstream of the spout device 4. This throughput limiter or flow rate regulator 20 is connected upstream of the attachment screen 6 in the direction of flow shown schematically in FIG. 1. Through its simple construction, the spout device shown here can also have a polygonally bounded perforated area. The spout device shown here is therefore in no way limited to a round outer cross section.

From FIGS. 3 and 4 it is to be seen that the attachment screen contacts the supply side of the jet-regulating device at least with its outer edge region. Here, the attachment screen 6 has a conical shape, so that contaminant particles possibly entrained in the water flow can be deposited onto its outer edge region on the supply side of the attachment screen 6, without significantly restricting the screening area of the attachment screen 6.

In FIG. 5, it can be seen easily that the essentially plate-shaped attachment screen has a honeycomb-like perforated area. Here, it is to be taken from FIGS. 3 and 4 that a housing neck 8 for forming a jet is connected downstream of the jet-regulating device 5 on the outlet end of the spout device 4. This housing neck 8 promotes the high jet quality and the good jet pattern of the spout device 4 according to the invention.

Figure 6:
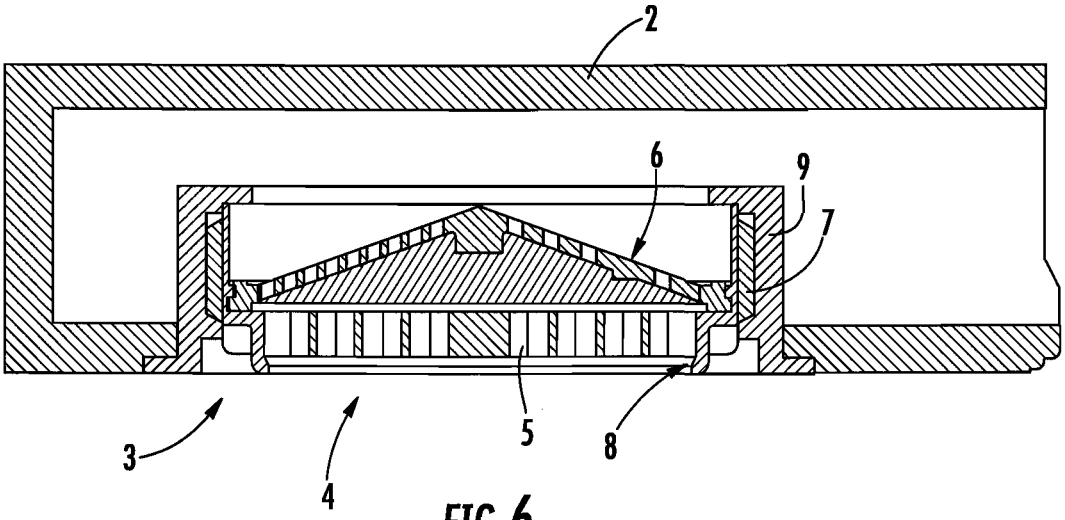

While in the spout device 1 shown in FIGS. 1 to 3 the water spout 3 is formed by a simple threaded opening, the water spout 3 of the spout fitment shown in FIG. 6 is defined by a mounting bushing 9. This mounting bushing 9 is inserted into a spout opening on the spout end region 1 of the spout fitment and carries on its inner periphery an internal thread, in which the external thread on the mounting sleeve 7 of the spout device 4 can be screwed.

In order to be able to screw the spout device 4 into the water spout 3 of a spout fitment 1 with little expense, it is advantageous when the spout device 4 has a contoured outer outline and/or a contoured outflow end side, which is shaped as a tool attachment surface for a tool insert. While in the spout fitment 1 shown in FIGS. 1 to 3, the water spout 3 is formed by a simple threaded opening in the spout fitment embodied as a thin-walled hollow profile, the water spout 3 of the spout fitment shown in FIG. 6 is limited by a mounting sleeve 9. This mounting sleeve 9 is inserted into a spout opening on the spout end region 1 of the spout fitment and carries on its inner periphery a relatively long internal thread, in which the external thread on the mounting sleeve 7 of the spout device 4 can be screwed.

From FIG. 6 it is clear that the spout device 4 can be screwed into the external thread of the mounting sleeve 9 approximately up to a ring shoulder 10. To prevent undesired leakage flows, an O-ring or a similar ring seal can be provided between the supply-side end region of the spout device 4 and the ring shoulder 10 in the region 11.

To be able to screw the spout device 4 into the water spout 3 of a spout fitment 1 with little expense, it is advantageous when the spout device 4 has a contoured outer outline and/or a contoured outflow end side, which is embodied as a tool attachment surface for a tool insert. The spout device 4 shown in FIG. 6 has, for example, a contoured outflow end side with at least two recesses 12, which are arranged on opposite sides of the spout device 4 and in which the fork-shaped ends of a tool insert not shown further here can engage when necessary.

An especially advantageous embodiment according to the invention, which is not shown here in more detail, provides that the outflow end side of a spout device 4 has contouring formed from end-edge projections and recesses, such that the recesses of a spout device 4 held in a spout fitment 1 can be used as a tool attachment surface for the projections of another spout device 4 that can be used as a tool insert.

For the spout device shown in FIG. 6, the jet-regulating device 5 is formed in one piece on the peripheral wall of the spout device 4 carrying the external thread. However, it is also possible that the jet-regulating device 5 is embodied as a separate individual part, which can be inserted into a sleeve-shaped insert housing of the spout device 4 forming the peripheral wall.

Figure 9:
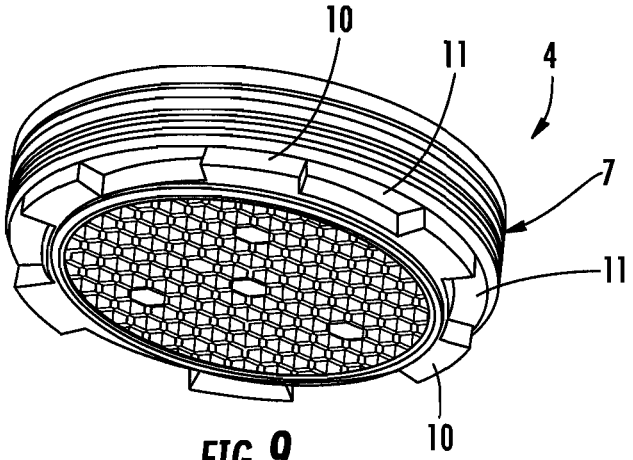
Figure 7:
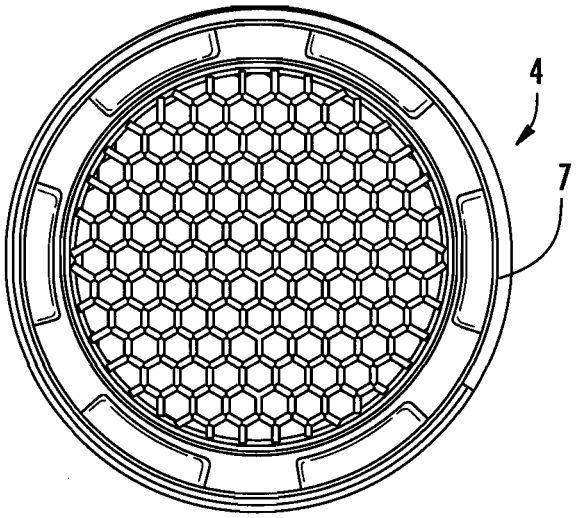
Figure 8:
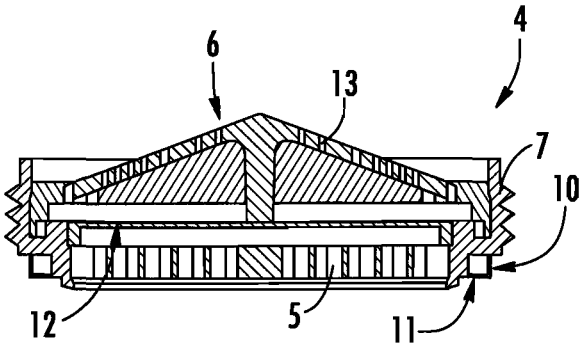

The spout device 4 shown in FIGS. 7 to 9 has a contoured outflow end side, which has contouring formed from end-edge projections 10 and recesses 11. This contouring formed by the projections 10 and the recesses 11 can be used as a tool attachment surface for the complementary recesses and projections of a tool insert.

From FIG. 8 it can be seen that a functional element is connected between the supply-side attachment screen 6 and the outflow-side jet-regulating device 5. Here, this functional element is embodied as a screen-like or grating-like insert part 12. The insert part 12 that can be inserted into a recess of the mounting sleeve 7 provided in the region of the jet-regulating device 5 promotes the high jet quality of the spout device shown here, wherein its screen or grating is formed by members crossing each other preferably at right angles. The insert part 12 can be formed by a metal screen or can also be produced as a plastic injection-molded part. From the longitudinal section in FIG. 8, it is to be taken that the attachment screen has a central support piece 13, which is supported on the supply-side end of the insert part 12 and which counteracts undesired deformation of the attachment screen 6 even at high water temperatures and/or high water pressures.

What is claimed is:

1. A low-profile plumbing spout device (4) having an upstream portion and a downstream portion comprising a mounting sleeve (7) having a generally cylindrical configuration, with external threads that matingly engage internal threads of a plumbing spout (3), the mounting sleeve (7) comprising a flow-rectifying device (5) integral with the mounting sleeve (7) at an outlet end of the plumbing spout device (4) at the downstream portion.

2. The spout device according to claim 1, further comprising an attachment screen (6) at an inlet end of the spout device (4), the attachment screen (6) connecting to the mounting sleeve (7) such that the attachment screen (6) is housed substantially within the mounting sleeve (7) and extends only partially past the threads of the mounting sleeve (7).

3. The spout device according to claim 1, wherein the spout device (4) has a contoured outer end face tool attachment surface projecting axially beyond the thread in a flow direction for a tool insert.

4. The spout device according to claim 1, wherein the attachment screen (6) is connected immediately upstream of the flow rectifying device (5) without an intermediate connection of other installation parts or functional units.

5. The spout device according to claim 1, wherein a throughput regulator or a throughput limiter is connected upstream of the attachment screen (6) in the direction of flow.

6. The spout device according to claim 1, wherein the attachment screen (6) directly contacts a supply side of the flow rectifying device (5) at an outer edge region thereof.

7. The spout device according to claim 1, wherein the flow rectifying device is formed as a perforated plate having a honeycomb-like structure.

8. The spout device according to claim 1, wherein a height to diameter ratio of the mounting sleeve is less than 0.5.

9. The spout device according to claim 1, wherein a height to diameter ratio of the mounting sleeve is less than 0.6.

10. A low-profile plumbing spout device (4), having an upstream portion and a downstream portion, comprising a mounting sleeve (7) having a generally cylindrical configuration, with external threads that matingly engage internal threads of a plumbing spout (3), the mounting sleeve (7) comprising a flow-rectifying device (5) integral with the mounting sleeve at an outlet end of the plumbing spout device (4) at the downstream portion, the flow-rectifying device being generally flush with a surface around the plumbing spout (3), a conical attachment screen (6) at an inlet end of the spout device (4) that is connected to the mounting sleeve, and a height to diameter ratio of the mounting sleeve is less than 0.5.

11. The spout device according to claim 10, further comprising an additional functional element to influence a jet quality of the device located between the conical attachment screen and the flow-rectifying device.

12. A low-profile plumbing spout device (4), having an upstream portion and a downstream portion, comprising a mounting sleeve (7) having a generally cylindrical configuration, with external threads that matingly engage internal threads of a plumbing spout (3), the mounting sleeve (7) comprising a flow-rectifying device (5) integral with the mounting sleeve at an outlet end of the plumbing spout device (4) at the downstream portion, the flow-rectifying device being generally flush with a surface around the plumbing spout (3), a conical attachment screen (6) at an inlet end of the spout device (4) that is connected to the mounting sleeve, and a height to diameter ratio of the mounting sleeve is less than 0.6.

13. The spout device according to claim 12, further comprising an additional functional element to influence a jet quality of the device located between the conical attachment screen and the flow-rectifying device.

* * * * *